US010650750B2

(12) United States Patent
Dighde et al.

(10) Patent No.: US 10,650,750 B2
(45) Date of Patent: May 12, 2020

(54) SUB-PIXEL COMPENSATION

(71) Applicant: MICROSOFT TECHNOLOGY LICENSING, LLC, Redmond, WA (US)

(72) Inventors: Rajesh Manohar Dighde, Redmond, WA (US); Ying Zheng, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 30 days.

(21) Appl. No.: 15/915,403

(22) Filed: Mar. 8, 2018

(65) Prior Publication Data

US 2018/0197477 A1 Jul. 12, 2018

Related U.S. Application Data

(63) Continuation of application No. 14/698,706, filed on Apr. 28, 2015, now Pat. No. 9,953,574.

(51) Int. Cl.

| | |
|---|---|
| ***G09G 3/3258*** | (2016.01) |
| ***G09G 3/20*** | (2006.01) |
| ***G09G 3/3233*** | (2016.01) |

(52) U.S. Cl.

CPC ..... *G09G 3/3258* (2013.01); *G09G 3/2003* (2013.01); *G09G 3/2074* (2013.01);

(Continued)

(58) Field of Classification Search

CPC .. G09G 3/3258; G09G 3/2074; G09G 3/2003; G09G 3/2081; G09G 3/3233;

(Continued)

(56) References Cited

U.S. PATENT DOCUMENTS

| | | | |
|---|---|---|---|
| 7,382,010 | B2 | 6/2008 | Choi |
| 7,414,630 | B2 | 8/2008 | Schweng et al. |

(Continued)

FOREIGN PATENT DOCUMENTS

| | | | |
|---|---|---|---|
| CN | 103927945 | A | 7/2014 |
| EP | 1225557 | A1 | 7/2002 |
| EP | 1389876 | A1 | 2/2004 |

OTHER PUBLICATIONS

"Screen Burn-in Tool—Android Apps on Google Play", Retrieved From: <<https://play.google.com/store/apps/details?id=com.codefortravel.amoled_screen_burn_in&hl=en>>, Apr. 30, 2014, 2 Pages.

(Continued)

*Primary Examiner* — Andrew Sasinowski

(74) *Attorney, Agent, or Firm* — NovoTechIP International PLLC

(57) ABSTRACT

Sub-pixel compensation is described. In at least some implementations, a computing device includes a plurality of sub-pixels within a pixel which may generate an alternating display to approximate the display of a single sub-pixel. In other implementations, a voltage is applied to sub-pixels of a color such that a voltage across a first sub-pixel is proportional to a voltage across one or more additional sub-pixels. In other implementations, a change in a voltage drop across a sub-pixel is detected, and the change is compensated for by altering a voltage of a second sub-pixel within the pixel.

20 Claims, 10 Drawing Sheets

(52) U.S. Cl.
CPC ..... *G09G 3/2081* (2013.01); *G09G 3/3233* (2013.01); *G09G 2300/0443* (2013.01); *G09G 2300/0452* (2013.01); *G09G 2300/0819* (2013.01); *G09G 2320/029* (2013.01); *G09G 2320/0233* (2013.01); *G09G 2320/0242* (2013.01); *G09G 2320/045* (2013.01); *G09G 2320/0626* (2013.01); *G09G 2330/04* (2013.01)

(58) Field of Classification Search
CPC ... G09G 2320/0626; G09G 2320/0233; G09G 2300/0819; G09G 2300/0443; G09G 2330/04; G09G 2320/045; G09G 2300/0452; G09G 2320/0242; G09G 2320/029
See application file for complete search history.

(56) References Cited

U.S. PATENT DOCUMENTS

| | | | | |
|---|---|---|---|---|
| 7,787,702 | B2 * | 8/2010 | Brown Elliott | G06T 5/009 382/260 |
| 7,825,970 | B2 | 11/2010 | Choi et al. | |
| 8,395,571 | B2 | 3/2013 | Kim et al. | |
| 8,432,337 | B2 | 4/2013 | You et al. | |
| 8,598,784 | B2 | 12/2013 | Ko | |
| 2007/0018073 | A1 | 1/2007 | Hsu et al. | |
| 2009/0058879 | A1 | 3/2009 | Li et al. | |
| 2009/0079351 | A1 | 3/2009 | Choi et al. | |
| 2010/0283803 | A1 | 11/2010 | Chou | |
| 2011/0043500 | A1 * | 2/2011 | Kwak | G09G 3/006 345/206 |
| 2011/0080441 | A1 * | 4/2011 | Wacyk | G09G 3/2081 345/691 |
| 2012/0274622 | A1 | 11/2012 | Huang et al. | |
| 2013/0194316 | A1 | 8/2013 | Park et al. | |
| 2013/0307869 | A1 | 11/2013 | Baumgart | |
| 2014/0184862 | A1 | 7/2014 | Schweng et al. | |
| 2014/0198133 | A1 | 7/2014 | Jung et al. | |
| 2015/0009194 | A1 * | 1/2015 | Kim | G09G 3/3233 345/211 |
| 2015/0014662 | A1 | 1/2015 | Huang et al. | |
| 2015/0077447 | A1 * | 3/2015 | Zhang | G02F 1/167 345/694 |
| 2016/0321989 | A1 | 11/2016 | Dighde et al. | |

OTHER PUBLICATIONS

"Will Samsung use diamond or hexagonal sub pixels in their new AMOLEDs?", Retrieved From: <<http://www.oled-info.com/will-samsung-use-diamond-or-hexagonal-sub-pixels-their-new-amoleds>>, Jan. 26, 2013, 2 Pages.
"Corrected Notice of Allowability Issued in U.S. Appl. No. 14/698,706", dated Jan. 5, 2018, 2 Pages.
"Non Final Office Action Issued in U.S Appl. No. 14/698,706", dated Jul. 6, 2017, 15 Pages.
"Notice of Allowance Issued in U.S. Appl. No. 14/698,706", dated Dec. 13, 2017, 7 Pages.
Lau, et al., "Blue-Noise Halftoning for Hexagonal Grids", In Proceedings of the IEEE Transactions on Image Processing, vol. 15, Issue 5, May 1, 2006, 13 Pages.
"International Preliminary Report on Patentability Issued in PCT Application No. PCT/US2016/026084", dated Jul. 7, 2017, 10 Pages.
"International Search Report and Written Opinion Issued in PCT Application No. PCT/US2016/026084", dated Sep. 22, 2016, 21 Pages.
"Second Written Opinion Issued in PCT Application No. PCT/US2016/026084", dated Mar. 28, 2017, 9 Pages.
Purcell, et al., "Hexagonal Array Processing", In Proceedings of the IEEE Workshop on Charge-Coupled Devices and Advanced Image Sensors, Jun. 1, 2001, 4 Pages.

* cited by examiner

SUB-PIXEL COMPENSATION

CROSS-REFERENCE TO RELATED APPLICATION

This application is a continuation of and claims priority under 35 U.S.C. § 120 to U.S. patent application Ser. No. 14/698,706, filed on Apr. 28, 2015 and entitled "Sub-Pixel Compensation," the entirety of which is incorporated by reference herein in its entirety.

BACKGROUND

Display devices generally use display technologies that either directly generate various colors, such as an Organic Light-Emitting Diode (OLED) display, or use white light through a gating structure, such as a Liquid Crystal Display (LCD) underneath a color element or color filter, to generate an image. However, display devices may suffer from component degradation during use, decreasing the luminance of components of the device. Further, components used to generate a color may degrade at different rates than components used to generate a different color. When the luminance of one color is decreased more than the luminance of other colors in a display device, the color balance of the device is altered which may result in an unpleasant appearance of images displayed on the display device.

SUMMARY

Sub-pixel compensation is described. In at least some implementations, a computing device includes a plurality of sub-pixels within a pixel which may generate an alternating display to approximate the display of a single sub-pixel. In other implementations, a voltage is applied to sub-pixels of a color such that a voltage across a first sub-pixel is proportional to a voltage across one or more additional sub-pixels. In other implementations, a change in a voltage drop across a sub-pixel is detected, and the change is compensated for by altering a voltage of a second sub-pixel within the pixel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Implementations of sub-pixel compensation are described, and may be utilized for an implementation of various display technologies, for example an OLED display. A device, such as a mobile phone, computer device, or television, has a display device that includes a display panel. The display panel has multiple sub-pixel combinations, where each pixel of the display panel is a combination of a plurality of sub-pixels. In various implementations, a sub-pixel combination includes any combination of numbers and colors of sub pixels. For example, a pixel may include eight sub-pixels, such as one sub-pixel of a first color, one sub-pixel of a second color, and six sub-pixels of a third color, two sub-pixels of a first color, two sub-pixels of a second color, and four sub-pixels of a third color, and so forth. The different colored sub-pixels in a sub-pixel combination collectively emit a color when illuminated.

Using a combination of sub-pixels, individual sub-pixel luminous intensity or display times may be adjusted without affecting the overall luminance of a pixel. Accordingly, individual sub-pixels may be adjusted to decrease driving time or intensity, thus decreasing the amount of component degradation that a sub-pixel may suffer and thus increase the lifetime of the display device as a whole.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
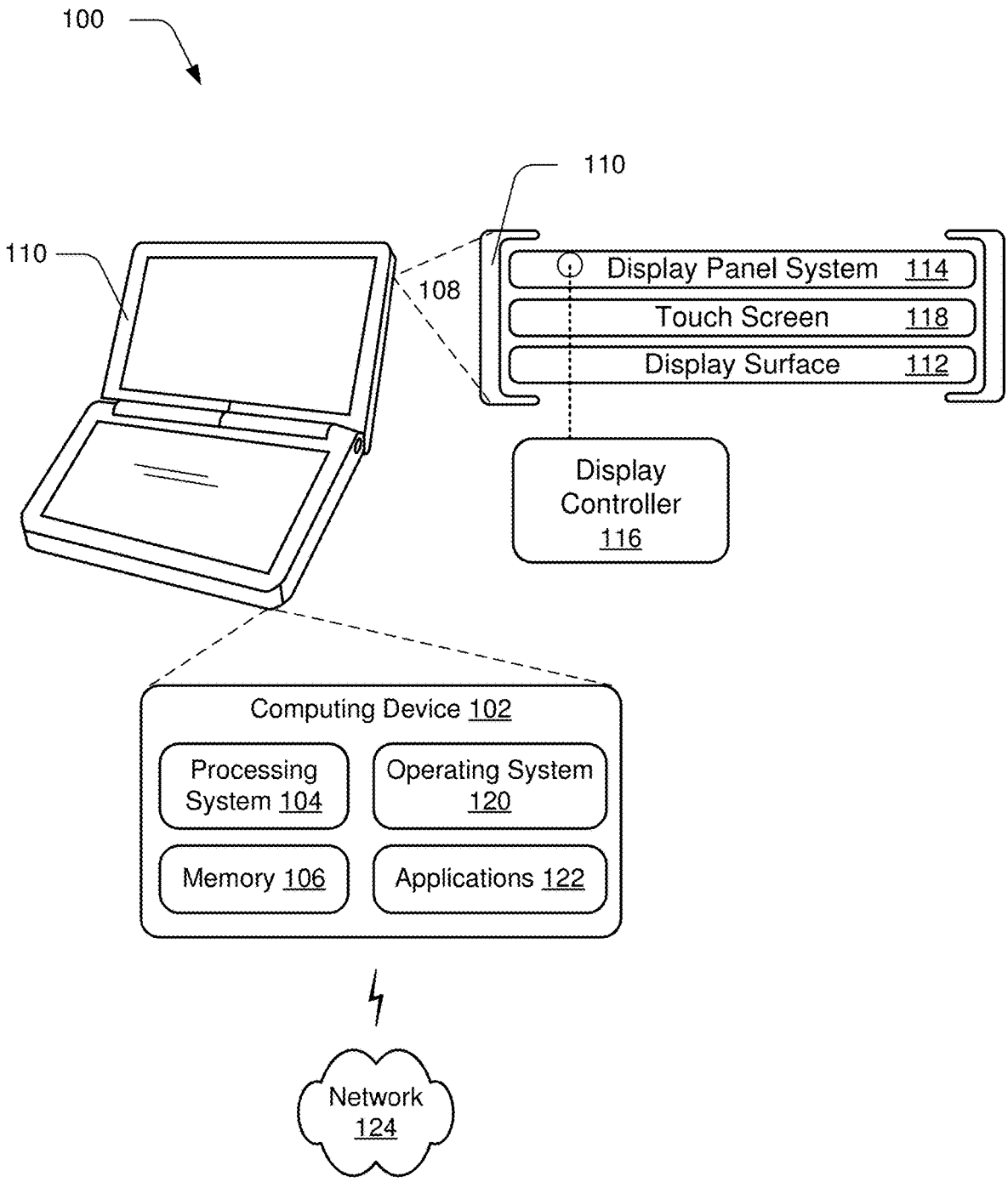
FIG. 1 is an illustration of an environment in an example implementation that is operable to employ techniques discussed herein in accordance with one or more implementations of sub-pixel compensation.

FIG. 1 is an illustration of an environment 100 in an example implementation that is operable to employ the sub-pixel compensation described herein. The illustrated environment 100 includes a computing device 102, which may be configured in a variety of ways.

Computing device 102 may be configured as any type or client of user device that includes fixed or mobile, wired and/or wireless devices, and may be implemented as a consumer, computer (e.g., a laptop or tablet device), portable, communication, phone (e.g., a dual-display phone), appliance, gaming, media playback, and/or electronic device. For example, computing device 102 may be a computer that is capable of communicating over a network, such as a desktop computer, a mobile station, an entertainment appliance, a set-top box communicatively coupled to a display device, a wireless phone, a game console, and so forth. Thus, the computing device 102 may range from full resource devices with substantial memory and processor resources (e.g., personal computers, game consoles) to a low-resource device with limited memory and/or processing resources (e.g., traditional set-top boxes, hand-held game consoles).

The computing device 102 is illustrated as including a variety of hardware components, examples of which include a processing system 104, an example of a computer-readable storage medium illustrated as a memory 106, a display device 108, and so on. The processing system 104 is representative of functionality to perform operations through execution of instructions stored in the memory 106. Although illustrated separately, functionality of these components may be further divided, combined (e.g., on an application specific integrated circuit), and so forth.

The display device 108 includes a display housing 110 that supports various display panels and surfaces that may be utilized to assemble the display device. In this example, the display device 108 includes a display surface 112, a display panel system 114, and a display controller 116. The display device may be implemented as an OLED panel or use other display technologies.

The display panel system 114 is implemented to display images that are then viewable through the display surface 112 of the display device 108. The display controller 116 is implemented to control display modes of the display device. The display controller can be implemented as computer-executable instructions, such as a software component, and executed by one or more processors to implement various implementations of sub-pixel compensation. In the illustrated example, the computing device 102 is implemented with a processor, a graphics processor unit, and an internal display controller to drive display content to the display device. In the display device 108, the display panel system 114 may include the display controller 116 that drives each pixel or sub-pixel according to the type of display at various voltages. The display device may also include a touch screen 118 that is located between the display surface 112 and the display panel system 114 to sense a touch input to the display surface.

The computing device 102 is further illustrated as including an operating system 120. The operating system 120 is configured to abstract underlying functionality of the computing device 102 to applications 122 that are executable on the computing device 102. For example, the operating system 120 may abstract processing system 104, memory 106, display device 108, and/or a network 124 functionality of the computing device 102 such that the applications 122 may be written without knowing "how" this underlying functionality is implemented. The applications 122, for instance, may provide data to the operating system 120 to be rendered and displayed by the display device 108 without understanding how this rendering will be performed. The operating system 120 may also represent a variety of other functionality, such as to manage a file system and user interface that is navigable by a user of the computing device 102.

Figure 2:
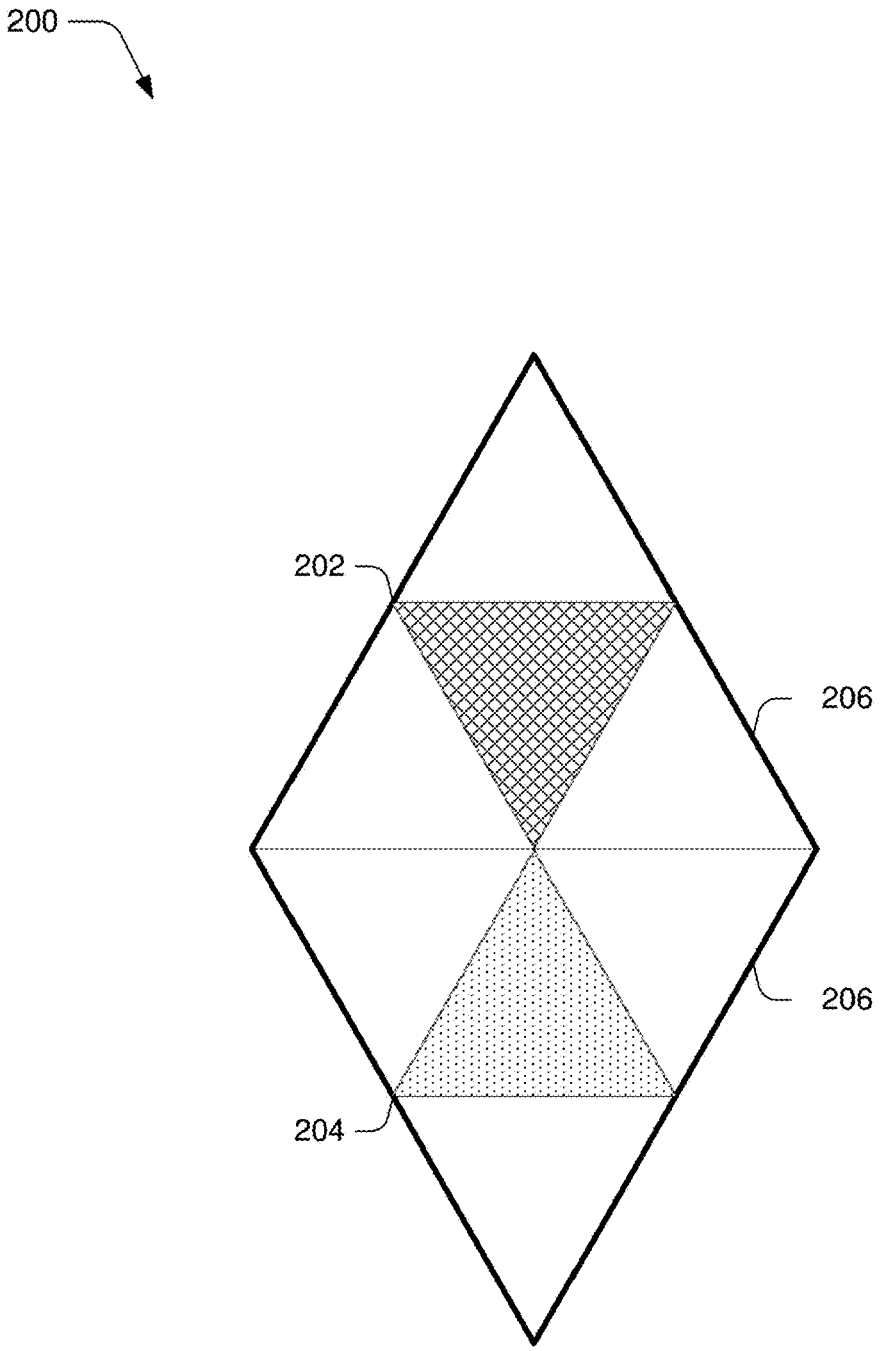
FIG. 2 is an illustration of a system in an example implementation showing a pixel of the sub-pixel compensation of FIG. 1 in greater detail.

FIG. 2 illustrates an example pixel 200 in implementations of sub-pixel compensation, which may be implemented as components of the display device 108 described with reference to FIG. 1. The pixel 200 includes green sub-pixel 202, red sub-pixel 204, and blue sub-pixels 206. However, it should be appreciated that pixel 200 may include any combination of colors of sub-pixels. For example, pixel 200 may include two green sub-pixels, two red sub-pixels, and four blue sub-pixels; or one red sub-pixel, one blue sub-pixel, and six green sub-pixels; and so forth.

Sub-pixels 202, 204, and 206 are configured as equilateral triangles in this example that collectively configure pixel 200 as a rhombus. Each of sub-pixels 202, 204, and 206 are identical in shape and size, although other examples are also contemplated. As illustrated, green sub-pixel 202 and red sub-pixel 204 are each adjacent to three blue sub-pixels 206.

Display controller 116 is configured to control generation of light of a particular color and luminous intensity for pixel 200. Each of sub-pixels 202, 204, and 206 is then driven at a luminous intensity such that the combined output of sub-pixels 202, 204, and 206 approximates the particular color and luminous intensity requested by display controller 116. To achieve this result, display controller 116 sends individual signals to green sub-pixel 202, red sub-pixel 204, and blue sub-pixels 206. The signal sent to blue sub-pixels 206 may be a single signal or a plurality of signals sent to respective sub-pixels.

In an implementation, each of blue sub-pixels 206 are driven at a same intensity. For example, if display controller 116 requests for pixel 200 to generate red light at an intensity of 6 and blue light at an intensity of 6, red sub-pixel 204 can be driven at an intensity of 6 and each of the six blue sub-pixels 206 can be driven simultaneously at an intensity of 1.

In another implementation, each of blue sub-pixels 206 is driven at differing intensities. For example, if display controller 116 requests for pixel 200 to generate red light at an intensity of 6 and blue light at an intensity of 6, red sub-pixel 204 can be driven at an intensity of 6 and three of blue sub-pixels 206 can be driven at an intensity of 2 while the remaining blue sub-pixels remain inactive, or one of blue sub-pixels 206 can be driven at an intensity of 6 while the remaining blue sub-pixels remain inactive.

Alternatively, a first blue sub-pixel 206 is driven by display controller 116, and one or more of blue sub-pixels 206 is driven in a manner that is dependent, compensatory, or reactionary to the driving of the first blue sub-pixel 206. For example, a blue sub-pixel 206 is driven to emit light at a luminous intensity, but due to component degradation the blue sub-pixel 206 may emit light at an intensity that is less than the expected intensity based on the driving voltage. To compensate, one or more additional blue sub-pixels 206 may be driven at an intensity proportional to the degradation of the blue sub-pixel.

Figure 3:
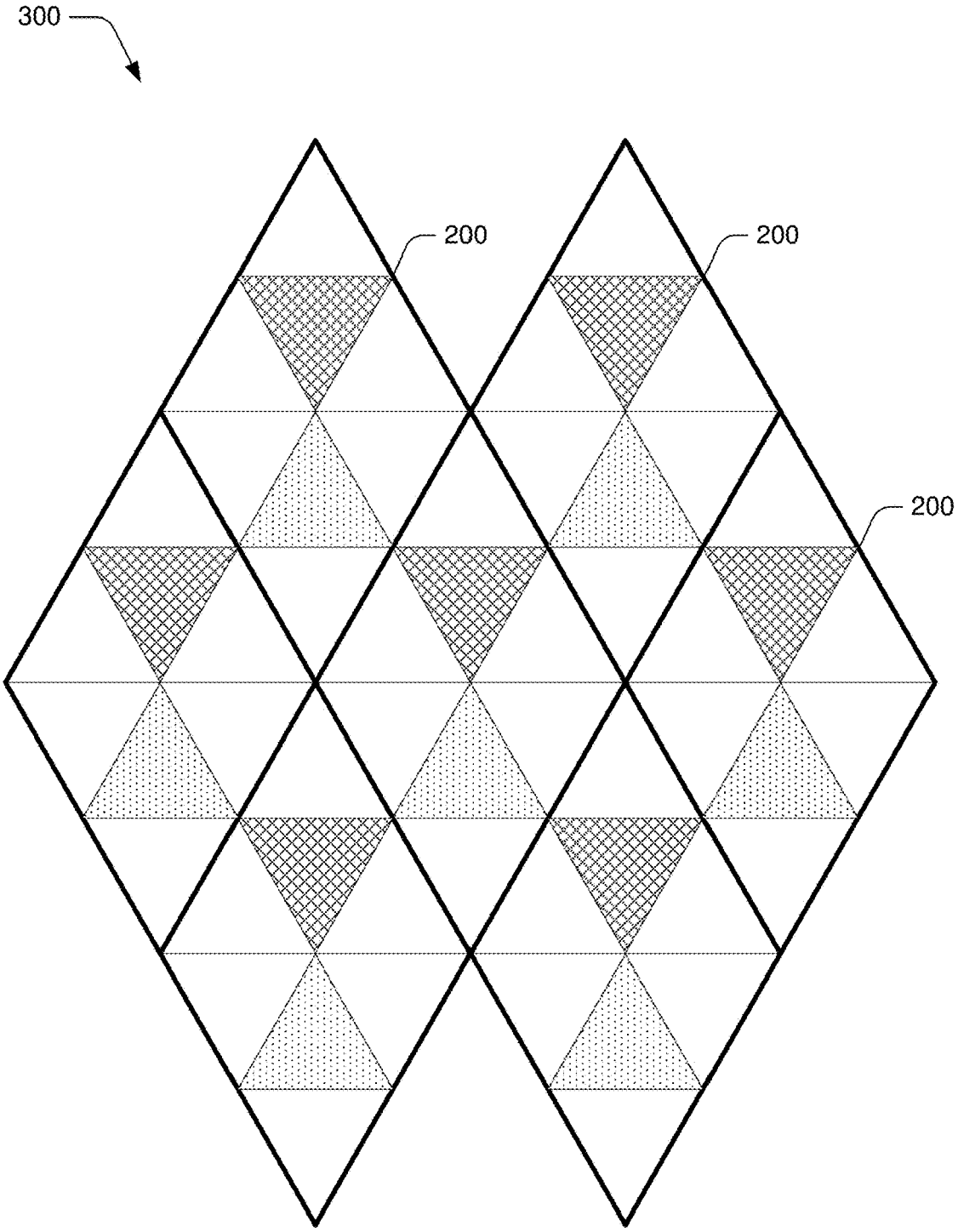
FIG. 3 is an illustration of a system in an example implementation showing a plurality of pixels of the sub-pixel compensation of FIG. 1 in greater detail.

FIG. 3 illustrates example pixels 300 in implementations of sub-pixel compensation, which are implemented as components of the display panel system 114 described with reference to FIG. 1. As a plurality of pixels 200 are placed adjacent each other, the sub-pixels form a hexagonal pattern. Although individual pixels are not hexagonal, any six sub-pixels sharing a common vertex form a hexagon. Further, blue sub-pixels 206 form hexagons, with green sub pixels 202 and red sub-pixels 204 occupying space between the blue hexagons. Lines forming from the edges of individual pixels are formed 30 degrees from vertical or 60 degrees from horizontal, and intersect at angles of 60 degrees and 120 degrees. However, any orientation may be used. For example, the pixels 300 may be oriented such that lines forming from the edges of individual pixels may form vertical or horizontal lines.

Figure 4:
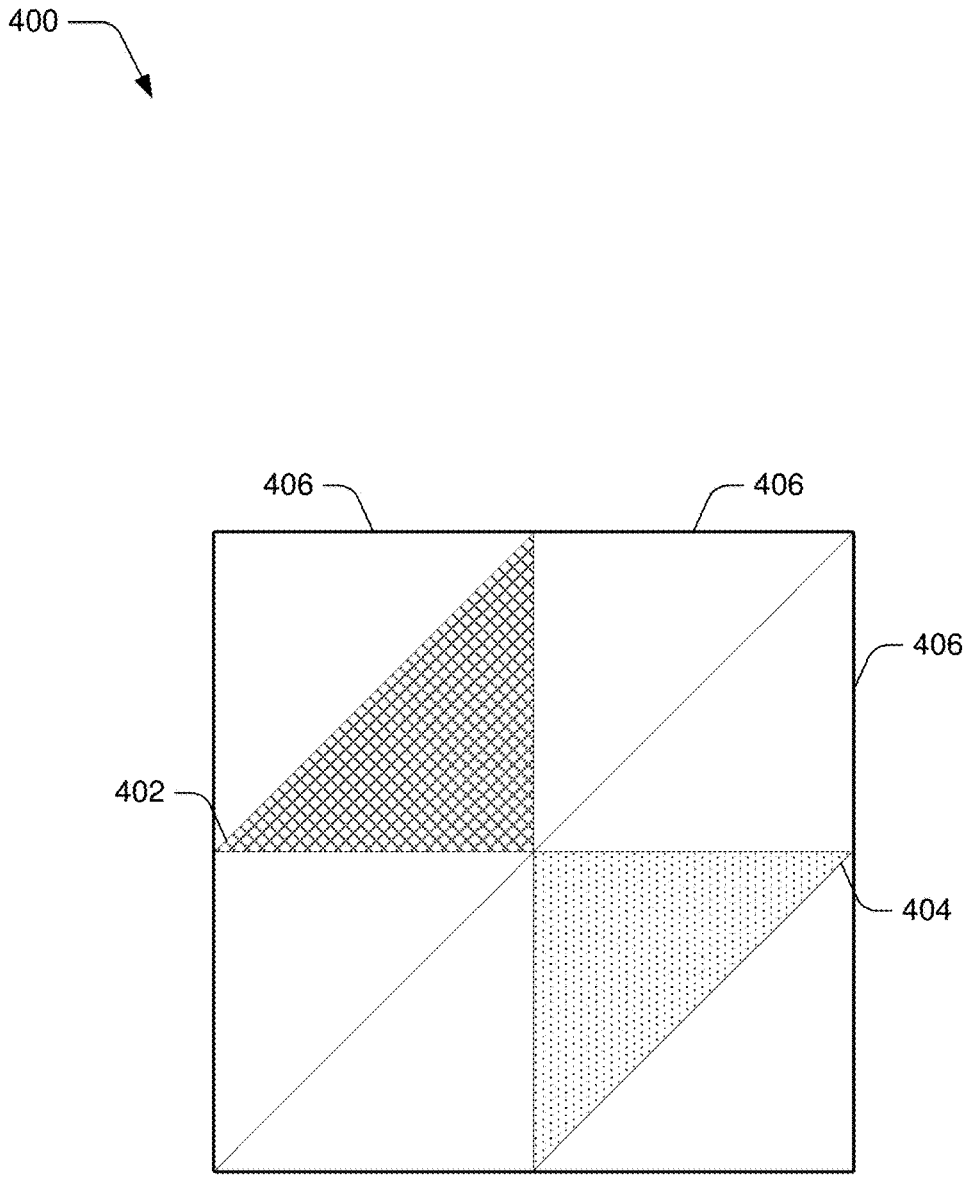
FIG. 4 is an illustration of a system in an example implementation showing a pixel of the sub-pixel compensation of FIG. 1 in greater detail.

FIG. 4 illustrates an example pixel 400 in implementations of sub-pixel compensation, which may be implemented as components of the display panel system 114 described with reference to FIG. 1. The pixel 400 includes green sub-pixel 402, red sub-pixel 404, and blue sub-pixels 406. However, it should be appreciated that pixel 400 may include any combination of sub-pixels. For example, pixel 400 may include two green sub-pixels, two red sub-pixels, four blue sub-pixels; or one red sub-pixel, one blue sub-pixel, and six green sub-pixels; and so forth.

Sub-pixels 402, 404, and 406 are right triangles and pixel 400 forms a square in the illustrated example. Each of sub-pixels 402, 404, and 406 are identical in shape and size, although other examples are also contemplated. As illustrated, green sub-pixel 402 and red sub-pixel 404 are each adjacent to three blue sub-pixels 406. Lines forming from the edges of individual pixels are formed as vertical and horizontal lines and intersect at angles of 90 degrees.

Figure 5:
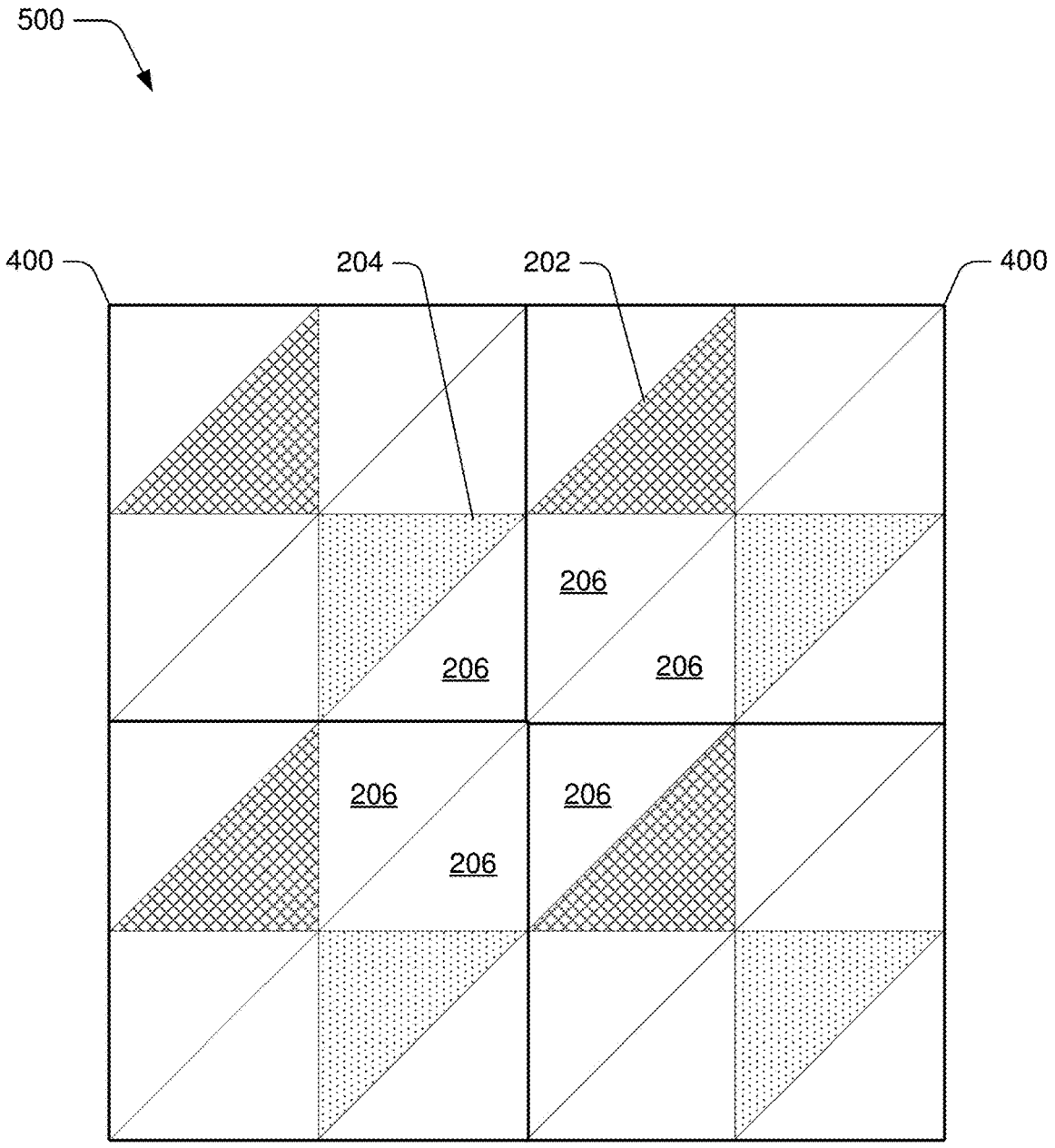
FIG. 5 is an illustration of a system in an example implementation showing a plurality of pixels of the sub-pixel compensation of FIG. 1 in greater detail.

FIG. 5 illustrates example pixels 500 in implementations of sub-pixel compensation, which may be implemented as components of the display panel system 114 described with reference to FIG. 1. As a plurality of pixels 400 are placed adjacent each other, the sub-pixels form a hexagonal pattern. Although individual pixels are not hexagonal, any six sub-pixels sharing a common vertex form a hexagon. Further, blue sub-pixels 206 form hexagons, with green sub pixels 202 and red sub-pixels 204 occupying space between the blue hexagons. Lines forming from the edges of individual pixels are formed as vertical and horizontal lines. However, any orientation may be used. For example, the pixels 300 may be oriented such that lines forming from the edges of individual pixels may form vertical or horizontal lines.

Figure 6:
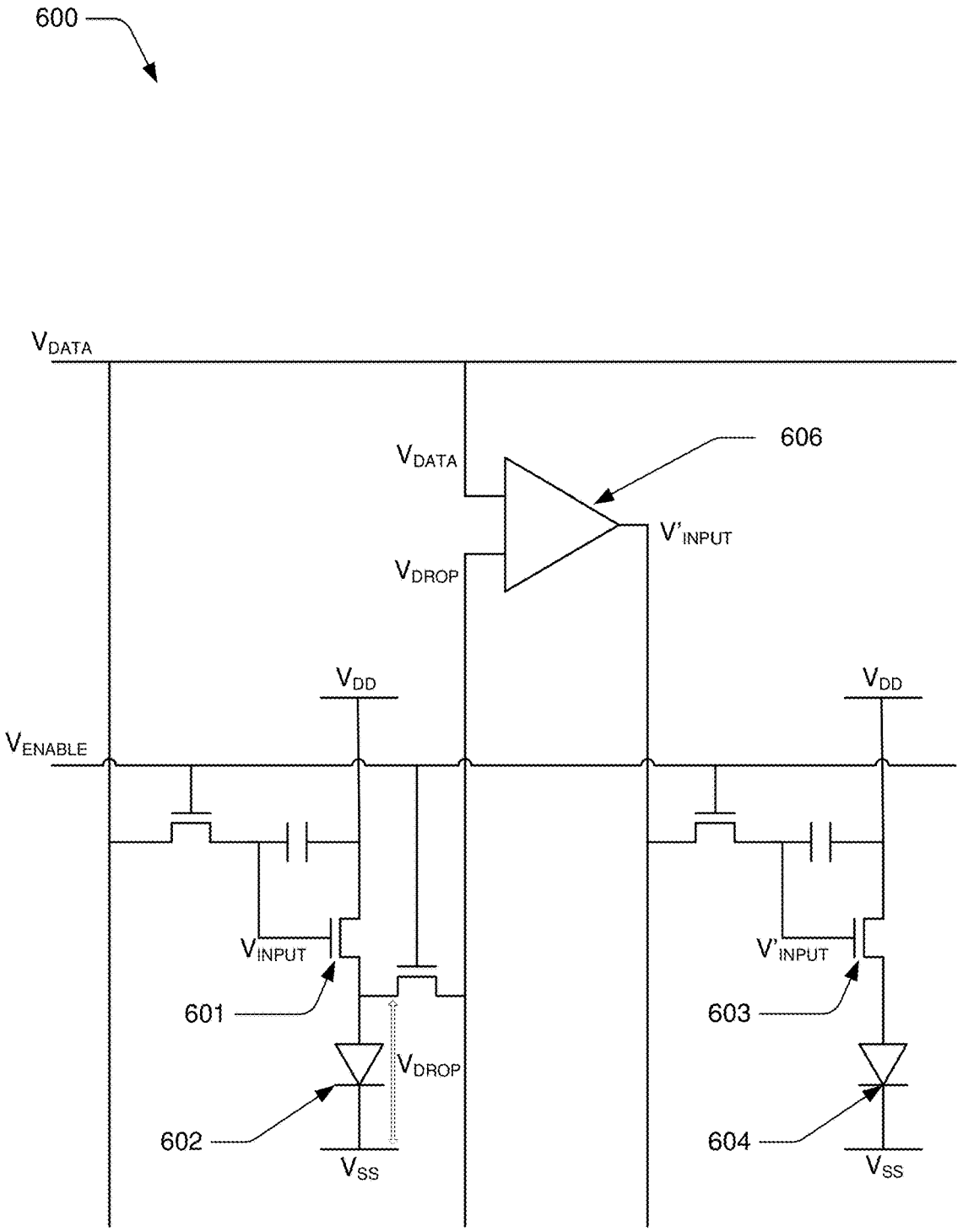
FIG. 6 is an illustration of a system in an example implementation showing a circuit that self-compensates for component degradation.

FIG. 6 illustrates example circuit 600 in implementations of sub-pixel compensation, which may be implemented as components of the display panel system 114 described with reference to FIG. 1. The circuit 600 includes driving transistors 601 and 603, lighting elements 602 and 604, and a compensation circuit block 606. However, it should be appreciated that circuit 600 may include any number and combination of OLEDs, transistors, amplifiers, capacitors, and the like.

The driving transistors 601 and 603 are depicted as thin-film transistors. However, the driving transistors 601 and 603 may be any form of transistors or may be any component capable of acting as an electronic switch. The lighting elements 602 and 604 are depicted as OLEDs. However, the lighting elements 602 and 604 may be any light emitting or generating component that may be susceptible to component degradation causing a decrease in luminance over time. The lighting elements 602 and 604 represent individual sub-pixels as described with reference to FIGS. 1-5. The compensation circuit block 606 represents any combination of components such that compensation circuit block 606 can compute a $V'_{INPUT}$ based on $V_{DATA}$ and $V_{DROP}$.

When $V_{INPUT}$ is applied to lighting element 602, lighting element 602 emits light. The intensity of light emitted correlates to the voltage drop across the lighting element 602. As lighting element 602 suffers from component degradation, the luminance of lighting element 602 decreases and the voltage drop across lighting element 602 increases. The compensation circuit block 606 is configured so that when there is little or no component degradation of lighting element 602, the compensation circuit block 606 has an output $V'_{INPUT}$ approximating 0 volts.

Accordingly, when there is little or no component degradation of lighting element 602, the input voltage to lighting element 604 approximates 0 and the lighting element 604 will produce little or no light. As the lighting element 602 degrades, the voltage drop across lighting element 602 increases, the difference between input voltages to the compensation circuit block 606 increases, and the output voltage of the compensation circuit block 606 increases.

As the component degradation of the lighting element 602 increases, the voltage applied to lighting element 604 automatically increases in a proportional fashion without requiring a second input or driving signal. In this manner, a driving signal applied to a circuit may produce a steady and consistent luminance over time regardless of component degradation without any need to monitor or adjust individual components.

Further, this technique may be applied any number of times to a circuit. For example, a third lighting element may be introduced to compensate for component degradation of lighting element 604, and so forth. Additionally or alternatively, the circuit 600 may include a plurality of lighting elements in place of lighting element 604. For example, lighting element 604 may include two OLEDs, so that as lighting element 602 degrades, both OLEDs of lighting element 604 simultaneously increase in luminance.

Example Procedures

The following discussion describes sub-pixel compensation techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to the figures described above.

Functionality, features, and concepts described in relation to the examples of FIGS. 1-6 may be employed in the context of the procedures described herein. Further, functionality, features, and concepts described in relation to different procedures below may be interchanged among the different procedures and are not limited to implementation in the context of an individual procedure. Moreover, blocks associated with different representative procedures and corresponding figures herein may be applied together and/or combined in different ways. Thus, individual functionality, features, and concepts described in relation to different example environments, devices, components, and procedures herein may be used in any suitable combinations and are not limited to the particular combinations represented by the enumerated examples.

Figure 7:
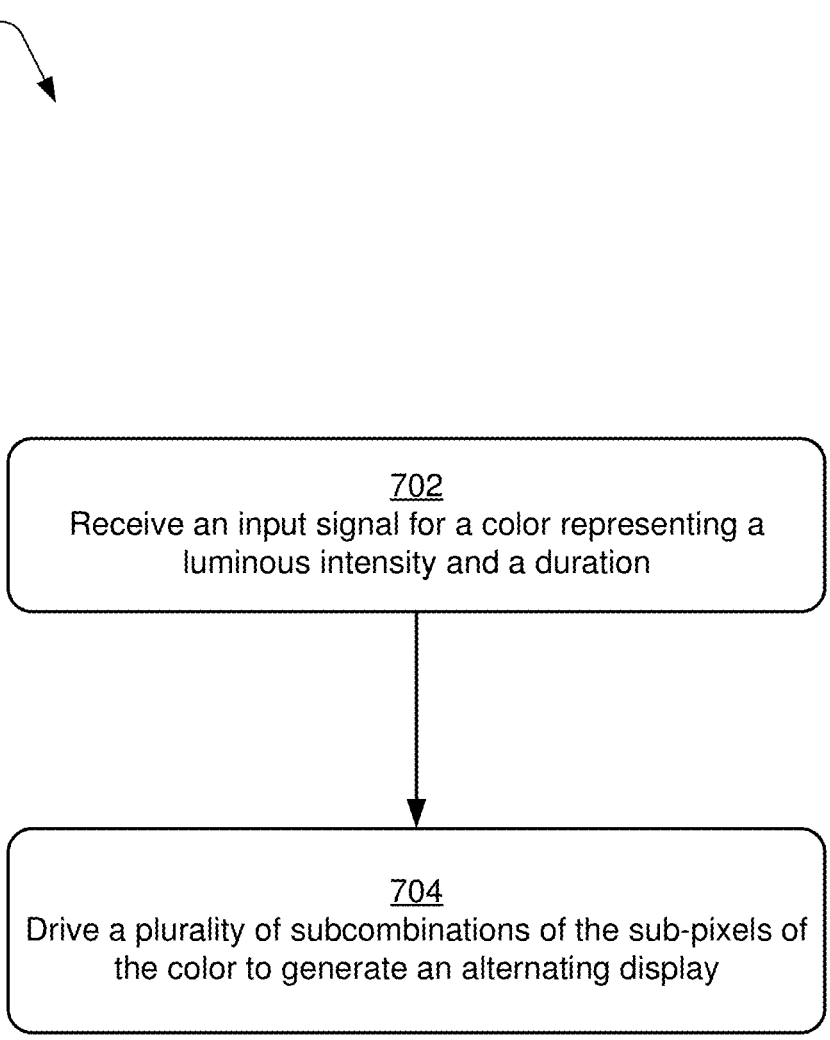
FIG. 7 is a flow diagram that describes steps in a method for driving subcombinations of sub-pixels of a color.

FIG. 7 is a flow diagram that describes steps in a method 700 for driving subcombinations of sub-pixels of a color. An input signal is received for a color representing a luminous intensity and a duration (block 702). For example, the input signal may be received by the display panel system 114 from the display controller 116. The input signal may represent any color, any luminous intensity or luminance, and any duration. For instance, an input signal is received indicating that a color blue is to be displayed at a luminous intensity of 1 cd for 0.25 seconds. In this case, the luminous intensity is divided by a known size of each sub-pixel to determine a corresponding luminance. Alternatively or additionally, an input signal is received indicating a luminance and a duration. For example, an input signal is received indicating that a color blue should be displayed at a luminance of 1000 cd/m$^2$ for 0.25 seconds. In this case, the luminance may be multiplied by a known size of each sub-pixel to determine a corresponding luminous intensity.

A plurality of subcombinations of the sub-pixels of the color are driven to generate an alternating display (block 704). For example, the display controller 116 drives the sub-pixels of the display panel system 114. There may be any number of available subcombinations of sub-pixels used to generate the alternating display. For instance, if the input signal indicates blue with a luminous intensity of 1 cd for 0.25 seconds and there are six blue sub-pixels, there may be two subcombinations of three blue sub-pixels that are driven at a luminous intensity of 1 cd with each subcombination driven once each for 0.125 seconds or twice each for 0.0625 seconds.

In another example, if the input signal indicates blue with a luminous intensity of 1 cd for 0.25 seconds and there are six blue sub-pixels, there may be three subcombinations of two blue sub-pixels that are driven at a luminous intensity of 1 cd with each subcombination driven once each for 0.083 seconds or twice each for 0.0417 seconds. Each subcombination may be driven at differing intensity and duration. For instance, if the input signal indicates blue with a luminous intensity of 1 cd for 0.25 seconds and there are six blue sub-pixels, there may be two subcombinations of three blue sub-pixels, with the first subcombination driven at a luminous intensity of 2.7 cd for 0.15 seconds and the second subcombination driven at a luminous intensity of 1 cd for 0.1 seconds.

Figure 8:
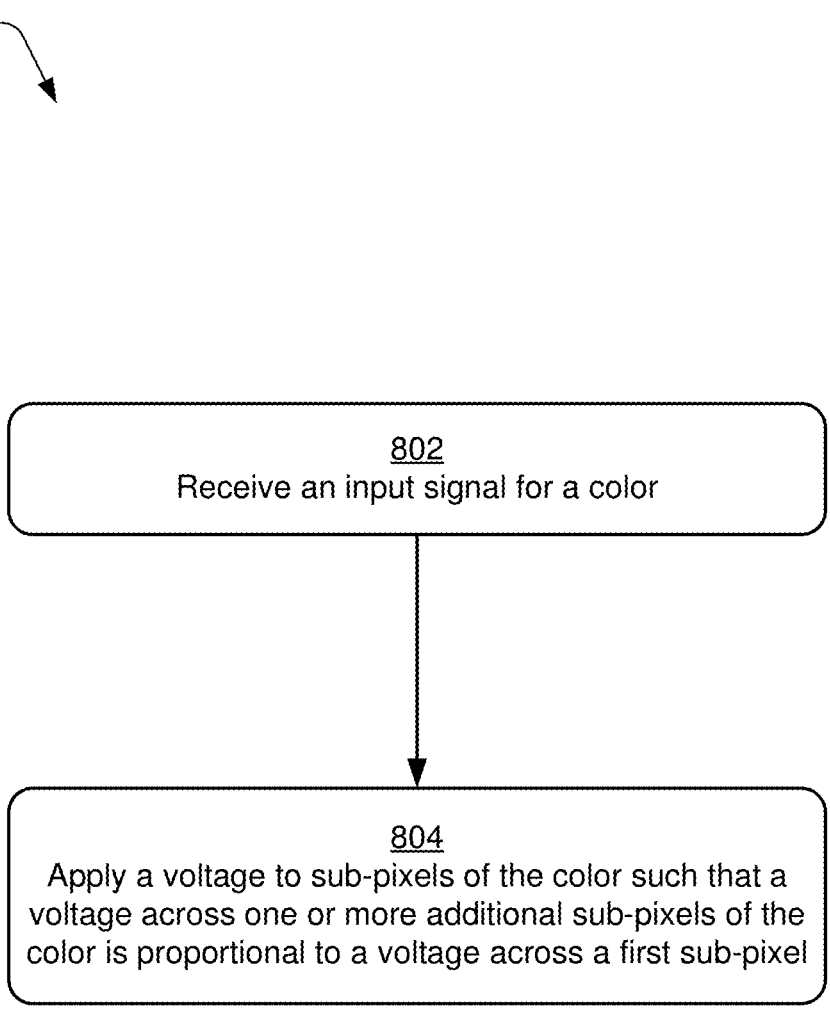
FIG. 8 is a flow diagram that describes steps in a method for driving sub-pixels of a color.

FIG. 8 is a flow diagram that describes steps in a method 800 for driving sub-pixels of a color. An input signal is received for a color (block 802). For example, the input signal may be received by the display panel system 114 from the display controller 116. The input signal may represent color, luminous intensity, luminance, duration, and/or any other attribute regarding a pixel of sub-pixel of the display panel system 114.

A voltage is applied to sub-pixels of the color such that a voltage across one or more additional sub-pixels of the color is proportional to a voltage across a first sub-pixel (block 804). This voltage is applied responsive to receiving the input signal of step 800. For example, a voltage may be applied to the circuit of FIG. 6 responsive to an input signal indicating that lighting elements 602 and 604 (sub-pixels of the color) should be activated. The voltage across lighting element 604 is proportional to the voltage across lighting element 602.

Figure 9:
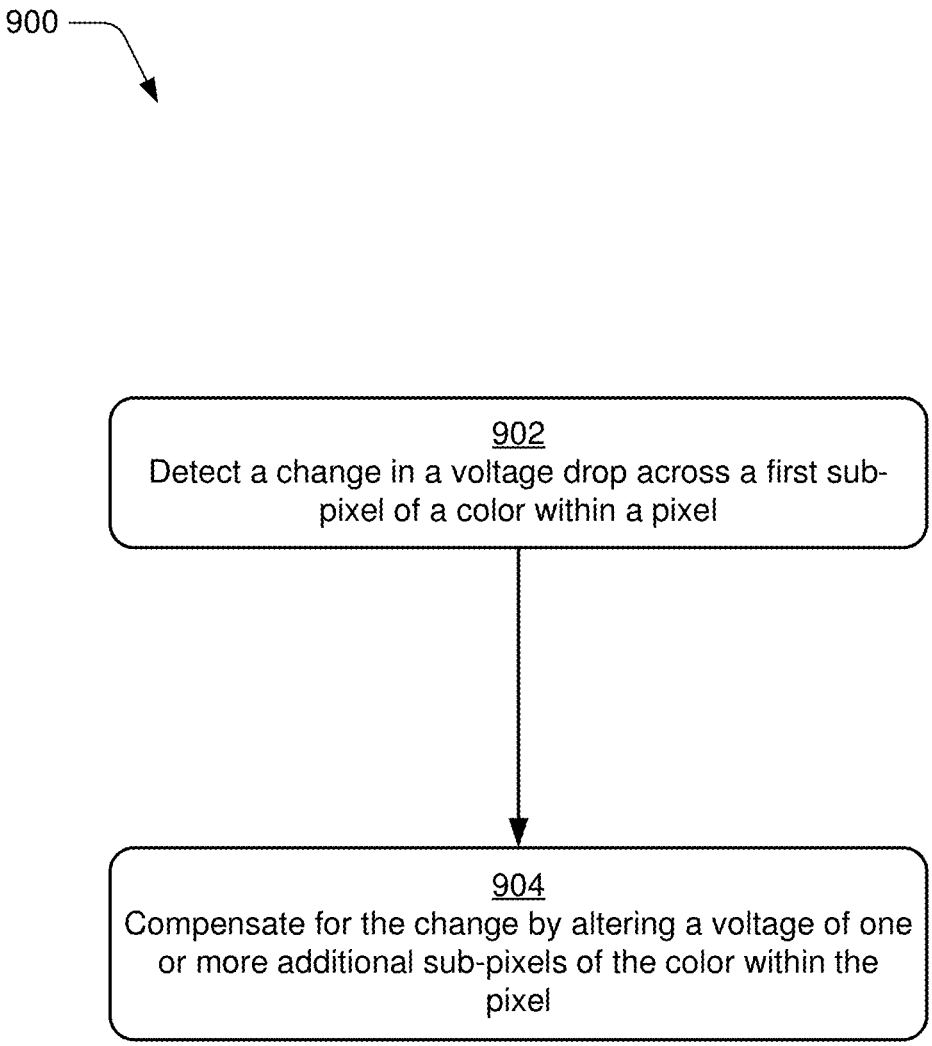
FIG. 9 is a flow diagram that describes steps in a method for compensating for a change in a voltage drop across a sub-pixel.

FIG. 9 is a flow diagram that describes steps in a method 900 for compensating for a change in a voltage drop across a sub-pixel. A change is detected in a voltage drop across a first sub-pixel of a color within a pixel (block 902). For example, a voltage drop across a sub-pixel of the display panel system 114 may be detected by the display controller 116. The change in a voltage drop may be due to component degradation of an OLED. An expected voltage drop across an OLED based on an input voltage, for instance, is compared to the actual voltage drop to determine the change in the voltage drop.

The change is compensated for by altering a voltage of one or more additional sub-pixels of the color within the pixel (block 904). For example, the display controller 116 may compensate for an increase in the voltage drop across a first blue sub-pixel 206 of FIG. 2 by increasing the voltage applied to a second blue sub-pixel 206 of FIG. 2. The compensation may be performed by a reactionary circuit such as that of FIG. 6, or may be performed by the display controller 116 in any other suitable manner.

Having discussed some example procedures, consider now a discussion of an example system and device in accordance with one or more implementations.

Example System and Device

Figure 10:
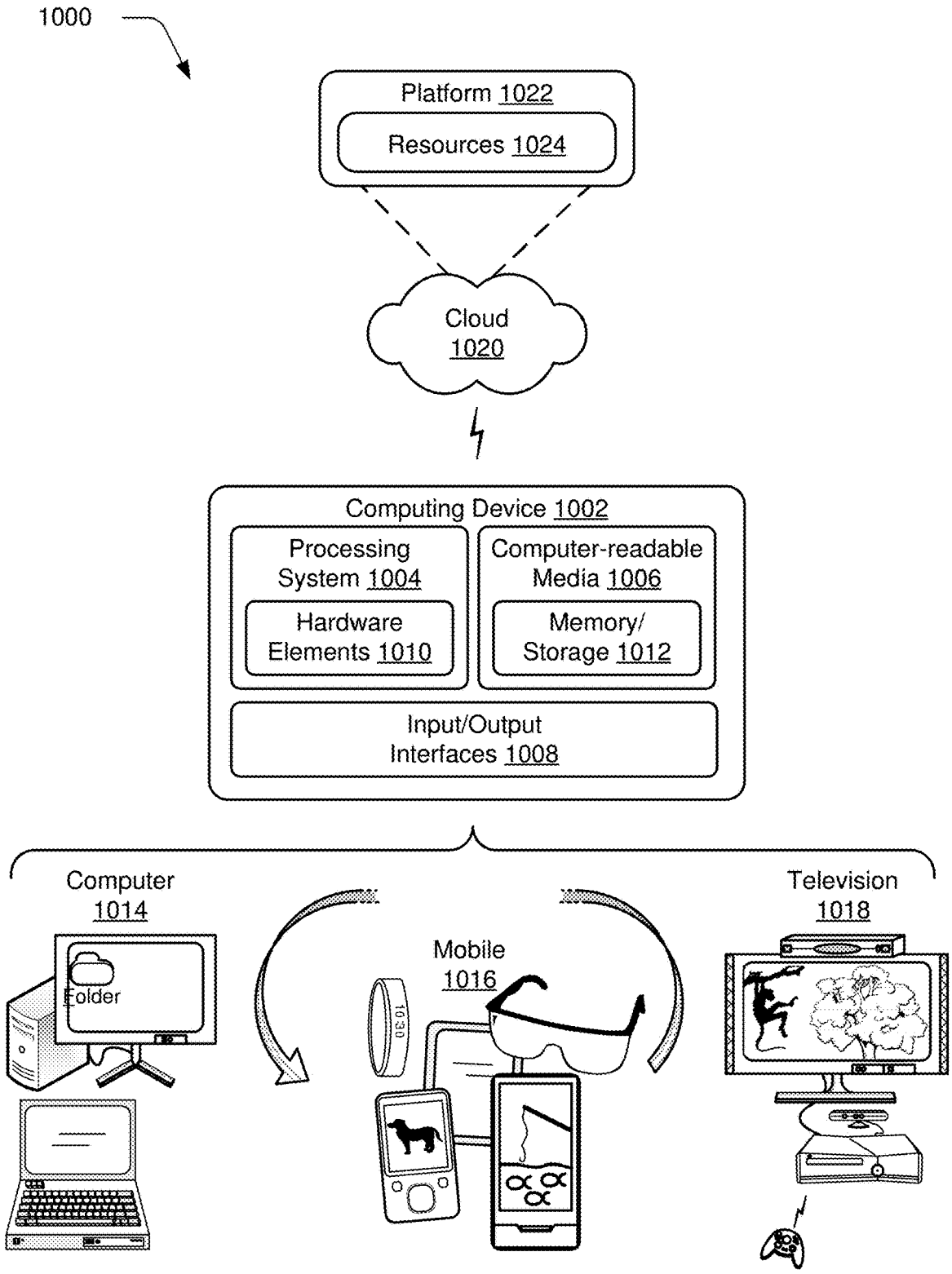
FIG. 10 illustrates an example system including various components of an example device that can be implemented as any type of computing device as described with reference to FIGS. 1-9 to implement embodiments of the techniques described herein.

FIG. 10 illustrates an example system generally at 1000 that includes an example computing device 1002 that is representative of one or more computing systems and/or devices that may implement the various techniques described herein. The computing device 1002 may be, for example, a server of a service provider, a device associated with a client (e.g., a client device), an on-chip system, and/or any other suitable computing device or computing system.

The example computing device 1002 as illustrated includes a processing system 1004, one or more computer-readable media 1006, and one or more I/O interface 1008 that are communicatively coupled, one to another. Although not shown, the computing device 1002 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 1004 is representative of functionality to perform one or more operations using hardware. Accordingly, the processing system 1004 is illustrated as including hardware element 1010 that may be configured as processors, functional blocks, and so forth. This may include implementation in hardware as an application specific integrated circuit or other logic device formed using one or more semiconductors. The hardware elements 1010 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 1006 is illustrated as including memory/storage 1012. The memory/storage 1012 represents memory/storage capacity associated with one or more computer-readable media. The memory/storage component 1012 may include volatile media (such as random access memory (RAM)) and/or nonvolatile media (such as read only memory (ROM), Flash memory, optical disks, magnetic disks, and so forth). The memory/storage component 1012 may include fixed media (e.g., RAM, ROM, a fixed hard drive, and so on) as well as removable media (e.g., Flash memory, a removable hard drive, an optical disc, and so forth). The computer-readable media 1006 may be configured in a variety of other ways as further described below.

Input/output interface(s) 1008 are representative of functionality to allow a user to enter commands and information to computing device 1002, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 1002 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 1002. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 1002, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 1010 and computer-readable media 1006 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 1010. The computing device 1002 may be configured to implement particular instructions and/or functions corresponding to the software and/or hardware modules. Accordingly, implementation of a module that is executable by the computing device 1002 as software may be achieved at least partially in hardware, e.g., through use of computer-readable storage media and/or hardware elements 1010 of the processing system 1004. The instructions and/or functions may be executable/operable by one or more articles of manufacture (for example, one or more computing devices 1002 and/or processing systems 1004) to implement techniques, modules, and examples described herein.

As further illustrated in FIG. 10, the example system 1000 enables ubiquitous environments for a seamless user experience when running applications on a personal computer (PC), a television device, and/or a mobile device. Services and applications run substantially similar in all three environments for a common user experience when transitioning from one device to the next while utilizing an application, playing a video game, watching a video, and so on.

In the example system 1000, multiple devices are interconnected through a central computing device. The central computing device may be local to the multiple devices or may be located remotely from the multiple devices. In one embodiment, the central computing device may be a cloud of one or more server computers that are connected to the multiple devices through a network, the Internet, or other data communication link.

In one embodiment, this interconnection architecture enables functionality to be delivered across multiple devices to provide a common and seamless experience to a user of the multiple devices. Each of the multiple devices may have different physical requirements and capabilities, and the central computing device uses a platform to enable the delivery of an experience to the device that is both tailored to the device and yet common to all devices. In one embodiment, a class of target devices is created and experiences are tailored to the generic class of devices. A class of devices may be defined by physical features, types of usage, or other common characteristics of the devices.

In various implementations, the computing device 1002 may assume a variety of different configurations, such as for computer 1014, mobile 1016, and television 1018 uses. Each of these configurations includes devices that may have generally different constructs and capabilities, and thus the computing device 1002 may be configured according to one or more of the different device classes. For instance, the computing device 1002 may be implemented as the computer 1014 class of a device that includes a personal computer, desktop computer, a multi-screen computer, laptop computer, netbook, and so on.

The computing device 1002 may also be implemented as the mobile 1016 class of device that includes mobile devices, such as a mobile phone, portable music player, portable gaming device, a tablet computer, a multi-screen computer, and so on. The computing device 1002 may also be implemented as the television 1018 class of device that includes devices having or connected to generally larger screens in casual viewing environments. These devices include televisions, set-top boxes, gaming consoles, and so on.

The techniques described herein may be supported by these various configurations of the computing device 1002 and are not limited to the specific examples of the techniques described herein. This functionality may also be implemented all or in part through use of a distributed system, such as over a "cloud" 1020 via a platform 1022 as described below.

The cloud 1020 includes and/or is representative of a platform 1022 for resources 1024. The platform 1022 abstracts underlying functionality of hardware (e.g., servers) and software resources of the cloud 1020. The resources 1024 may include applications and/or data that can be utilized while computer processing is executed on servers that are remote from the computing device 1002. Resources 1024 can also include services provided over the Internet and/or through a subscriber network, such as a cellular or Wi-Fi network.

The platform 1022 may abstract resources and functions to connect the computing device 1002 with other computing devices. The platform 1022 may also serve to abstract scaling of resources to provide a corresponding level of scale to encountered demand for the resources 1024 that are implemented via the platform 1022. Accordingly, in an interconnected device embodiment, implementation of functionality described herein may be distributed throughout the system 1000. For example, the functionality may be implemented in part on the computing device 1002 as well as via the platform 1022 that abstracts the functionality of the cloud 1020.

Conclusion and Example Implementations

Example implementations described herein include, but are not limited to, one or any combinations of one or more of the following examples:

Example 1: A device comprising: a plurality of pixels, each pixel including a plurality of sub-pixels of a color that match, one to another, that are individually drivable to cause output of the color; and a driving circuit configured to: receive, for at least one of the plurality of pixels, an input signal for the color representing a luminous intensity and a duration; and based on the input signal, drive a plurality of subcombinations of the sub-pixels of the color of the at least one pixel to generate an alternating display of the plurality of subcombinations to approximate a luminance of a single sub-pixel at the luminous intensity.

Example 2: The device of example 1, wherein a number of sub-pixels of the color is six, and each pixel further includes one or more sub-pixels of a second color and one or more sub-pixels of a third color.

Example 3: The device of example 1, wherein each of the plurality of subcombinations is a single sub-pixel and each subcombination is driven sequentially at the luminous intensity for a duration that approximates the duration specified by the input divided by a number of the plurality of sub-pixels.

Example 4: The device of example 1, wherein a number of sub-pixels of the color is six, and each pixel further includes one or more sub-pixels of a second color, and one or more sub-pixels of a third color, the color is blue, the second color is red, and the third color is green.

Example 5: The device of example 1, wherein a number of sub-pixels of the color is six, and each pixel further includes one sub-pixel of a second color and one sub-pixel of a third color, each sub-pixel of the second color is adjacent to three sub-pixels of the color, and each sub-pixel of the third color is adjacent to three sub-pixels of the color.

Example 6: The device of example 1, wherein a number of sub-pixels of the color is six, and each pixel further includes one sub-pixel of a second color, and one sub-pixel of a third color, and each sub-pixel is triangular in shape.

Example 7: The device of example 1, wherein a number of sub-pixels of the color is six, and each pixel further includes one sub-pixel of a second color, and one sub-pixel of a third color, each sub-pixel is triangular in shape and each pixel is quadrilateral in shape.

Example 8: The device of example 1, wherein each sub-pixel is an organic light-emitting diode that is triangular in shape, each pixel is quadrilateral in shape, the number of sub-pixels of the color is six, and each pixel further includes one sub-pixel of a second color, and one sub-pixel of a third color, the color is blue, the second color is red, and the third color is green.

Example 9: A device comprising: a plurality of pixels, each pixel comprising a first sub-pixel of a color and one or more additional sub-pixels of the color; and a driving circuit configured to: receive an input signal including the color; and responsive to receiving the input signal, apply a voltage to the sub-pixels of the color such that a voltage across the one or more additional sub-pixels is proportional to a voltage across the first sub-pixel.

EXAMPLE 10

The device of example 9, wherein the driving circuit further comprises a compensation circuit block with a first input voltage, second input voltage, and output voltage, the first input voltage is the applied voltage, the second input voltage is the voltage across the first sub-pixel, and the output voltage is the voltage across the one or more additional sub-pixels.

EXAMPLE 11

The device of example 9, wherein each sub-pixel is triangular in shape and each pixel is quadrilateral in shape.

EXAMPLE 12

The device of example 9, each pixel further comprising one or more sub-pixels of a second color and one or more sub-pixels of a third color.

EXAMPLE 13

The device of example 9, each pixel further comprising one or more sub-pixels of a second color and one or more sub-pixels of a third color, wherein the color is blue, the second color is red, and the third color is green, there are fewer red sub-pixels than blue sub-pixels, and there are fewer green sub-pixels than blue sub-pixels.

EXAMPLE 14

The device of example 9, each pixel further comprising one or more sub-pixels of a second color and one or more sub-pixels of a third color, wherein the color is blue, the second color is red, and the third color is green, there are fewer red sub-pixels than blue sub-pixels, and there are fewer green sub-pixels than blue sub-pixels, each sub-pixel is an organic light-emitting diode, and each sub-pixel is the same size.

EXAMPLE 15

The device of example 9, the driving circuit further configured to adjust the voltage across the one or more additional sub-pixels responsive to a change in the voltage across the first sub-pixel.

EXAMPLE 16

The device of example 9, the driving circuit further configured to adjust the voltage across the one or more additional sub-pixels responsive to a change in the voltage across the first sub-pixel without adjusting the applied voltage.

EXAMPLE 17

A method comprising: detecting a change by a display device in a voltage drop across a first sub-pixel of a color within a pixel of the display device; and compensating for the change by the display device by altering a voltage of a second sub-pixel of the color within the pixel of the display device.

EXAMPLE 18

The method of example 17, wherein: a first voltage applied to the first sub-pixel and a second voltage applied to the second sub-pixel have a same driving history; and the second voltage is proportional to the first voltage.

EXAMPLE 19

The method of example 17, wherein: a first voltage applied to the first sub-pixel and a second voltage applied to the second sub-pixel have a same driving history; the second voltage is proportional to the first voltage; and the first voltage is used as a reference to determine the second voltage.

EXAMPLE 20

The method of example 17, wherein: a first voltage applied to the first sub-pixel and a second voltage applied to the second sub-pixel have the same driving history; the second voltage is proportional to the first voltage; the first voltage is used as a reference to determine the second voltage; and the second voltage is applied to one or more additional sub-pixels of the color within the pixel.

Although the example implementations have been described in language specific to structural features and/or methodological acts, it is to be understood that the implementations defined in the appended claims is not necessarily limited to the specific features or acts described. Rather, the specific features and acts are disclosed as example forms of implementing the claimed features.

What is claimed is:

1. A device comprising:

a plurality of pixels including a first pixel, the first pixel including a first sub-pixel of a first color and a second sub-pixel of the first color; and a driving circuit configured to:

receive an input signal representing a luminous intensity for the first color for the first pixel for a first duration; and in response to the received input signal and during the first duration, alternately drive the first sub-pixel and the second sub-pixel by driving the first sub-pixel for a second duration and driving the second sub-pixel for a third duration, wherein a length of the second duration is shorter than a length of the first duration and a length of the third duration is shorter than the length of the first duration.

2. The device of claim 1, wherein:

the first pixel further includes a third sub-pixel of the first color; and the driving circuit is further configured to, in response to the received input signal, drive the third sub-pixel simultaneously with the first sub-pixel.

3. The device of claim 1, wherein the first sub-pixel is driven during the second duration at a same luminous intensity as the second sub-pixel is driven during the third duration.

4. The device of claim 1, wherein the first sub-pixel is driven during the second duration at a different luminous intensity than the second sub-pixel is driven during the third duration.

5. The device of claim 1, wherein the length of the second duration is different than the length of the third duration.

6. The device of claim 1, wherein:

the first pixel includes a plurality of subcombinations of sub-pixels, each of the subcombinations of sub-pixels including a plurality of sub-pixels of the first color, wherein the plurality of subcombinations of sub-pixels includes a first subcombination of sub-pixels including the first sub-pixel and also includes a second subcombination of sub-pixels including the second sub-pixel;

the length of the second duration approximates the length of the first duration divided by a number of the subcombinations of sub-pixels;

the length of the third duration approximates the length of the first duration divided by a number of the subcombinations of sub-pixels; and the driving circuit is further configured to, in response to the received input signal and during the first duration, sequentially drive each subcombination of sub-pixels.

7. The device of claim 1, wherein:

the first sub-pixel is a triangular organic light-emitting diode (OLED); and the second sub-pixel is a triangular OLED.

8. The device of claim 1, wherein:

the first pixel is square in shape, with a first edge of the first pixel formed along a vertical line and a second edge of the first pixel formed along a horizontal line intersecting the vertical line at 90 degrees;

the plurality of pixels includes a second pixel vertically adjacent to the first pixel, square in shape, and with an edge of the second pixel formed along the vertical line; and the plurality of pixels includes a third pixel horizontally adjacent to the first pixel, square in shape, and with an edge of the second pixel formed along the horizontal line.

9. The device of claim 1, wherein:

the first pixel includes two or more sub-pixels of the first color;

the first pixel includes one or more sub-pixels of a second color different than the first color;

the first pixel includes one or more sub-pixels of a third color different than the first color and the second color;

the first pixel includes fewer sub-pixels of the second color than sub-pixels of the first color; and the first pixel includes fewer sub-pixels of the third color than sub-pixels of the first color.

10. The device of claim 1, wherein:

the first pixel further includes a third sub-pixel of the first color;

and the driving circuit is further configured to, while driving the first-subpixel during the first duration:

in response to the received input signal, apply a first voltage to the first sub-pixel;

output a second voltage computed based on the first voltage and a voltage drop occurring across the first sub-pixel during the application of the first voltage to the first sub-pixel; and apply the second voltage to the third sub-pixel.

11. The device of claim 1, wherein the first pixel includes a total of six sub-pixels of the first color.

12. A device comprising:

a plurality of pixels including a first pixel, the first pixel including a first sub-pixel of a first color and a second sub-pixel of the first color; and a driving circuit configured to:

receive an input signal voltage representing a luminous intensity for the first color for the first pixel for a first duration;

apply the input signal voltage to the first sub-pixel;

output a first voltage computed based on the input signal voltage and a voltage drop occurring across the first sub-pixel during the application of the input signal to the first sub-pixel; and apply the first voltage to the second sub-pixel.

13. The device of claim 12, wherein the first pixel includes a third sub-pixel of the first color, and the driving circuit is further configured to:

output a second voltage computed based on the first voltage and a voltage drop occurring across the second sub-pixel during the application of the first voltage to the second sub-pixel; and apply the second voltage to the third sub-pixel.

14. The device of claim 12, wherein the first pixel includes a third sub-pixel of the first color, and the driving circuit is configured to simultaneously apply the first voltage to the third sub-pixel and the second sub-pixel.

15. The device of claim 12, wherein:

the first pixel includes two or more sub-pixels of the first color;

the first pixel includes one or more sub-pixels of a second color different than the first color;

the first pixel includes one or more sub-pixels of a third color different than the first color and the second color;

the first pixel includes fewer sub-pixels of the second color than sub-pixels of the first color; and the first pixel includes fewer sub-pixels of the third color than sub-pixels of the first color.

16. The device of claim 12, wherein the first voltage is calculated in proportion to the voltage drop occurring across the first sub-pixel during the application of the input signal to the first sub-pixel.

17. The device of claim 12, wherein:

the driving circuit includes a compensation circuit block configured to receive a first input voltage at a first input, receive a second input voltage at a second input, calculate a first output voltage based on the first input voltage and the second input voltage, and output the first output voltage at a second output; and the driving circuit is configured to:

apply the input signal voltage to the first input, during the first duration, selectively couple the second input to the first sub-pixel to receive a voltage corresponding to the voltage drop occurring across the first sub-pixel during the application of the input signal to the first sub-pixel, and during the first duration, selectively couple the first output to the second sub-pixel to apply the first output to the second sub-pixel.

18. A method comprising:

receiving an input signal representing a luminous intensity for a first color for a first pixel for a first duration, the first pixel including a first sub-pixel of the first color and a second sub-pixel of the first color; and in response to receiving the input signal and during the first duration, alternately driving the first sub-pixel and the second sub-pixel by driving the first sub-pixel for a second duration and driving the second sub-pixel for a third duration, wherein a length of the second duration is shorter than a length of the first duration and a length of the third duration is shorter than the length of the first duration.

19. The method of claim 18, wherein the length of the second duration is different than the length of the third duration or the first sub-pixel is driven during the second duration at a different luminous intensity than the second sub-pixel is driven during the third duration.

20. The method of claim 18, wherein:

the first pixel includes a plurality of subcombinations of sub-pixels, each of the subcombinations of sub-pixels including a plurality of sub-pixels of the first color, wherein the plurality of subcombinations of sub-pixels includes a first subcombination of sub-pixels including the first sub-pixel and also includes a second subcombination of sub-pixels including the second sub-pixel;

the length of the second duration approximates the length of the first duration divided by a number of the subcombinations of sub-pixels;

the length of the third duration approximates the length of the first duration divided by a number of the subcombinations of sub-pixels; and the method further comprises, in response to receiving the input signal and during the first duration, sequentially drive each subcombination of sub-pixels.

* * * * *